United States Patent [19]

Haber

[11] 4,120,074

[45] Oct. 17, 1978

[54] SNAP-LOCKING HINGE

[76] Inventor: David A. Haber, 320-B Ave. C, Gunter AFS, Ala. 36115

[21] Appl. No.: 803,062

[22] Filed: Jun. 3, 1977

[51] Int. Cl.[2] ..... E05D 1/06; E05D 7/10

[52] U.S. Cl. ..... 16/171; 16/172

[58] Field of Search ..... 16/171, 172, 174, 128 R, 16/149, 128, 142

[56] References Cited

U.S. PATENT DOCUMENTS

| | | | |
|---|---|---|---|
| 1,162,237 | 11/1915 | Hipolito | 16/172 |
| 1,337,689 | 4/1920 | Calvelage | 16/172 |
| 1,528,599 | 3/1925 | Belville | 16/171 |
| 1,825,595 | 9/1931 | Kohl | 16/172 X |
| 1,850,687 | 3/1932 | Pascoe et al. | 16/172 |
| 2,244,136 | 6/1941 | Zercher | 16/172 |
| 2,621,361 | 12/1952 | Schmitt | 16/172 |
| 2,857,618 | 10/1958 | Jordan | 16/142 |

FOREIGN PATENT DOCUMENTS

| | | | |
|---|---|---|---|
| 528,052 | 7/1956 | Canada | 16/172 |

*Primary Examiner*—James Kee Chi

[57] ABSTRACT

A snap-locking mechanism, for being incorporated into an inexpensive hinge, which, in various forms of the invention, can be locked in a fully opened, partly opened or closed positions as preferred; the snap-locking mechanism including a snap-locking member configurated with at least one or more notches, behind which an edge of a pivotable hinged plate gets locked.

2 Claims, 8 Drawing Figures

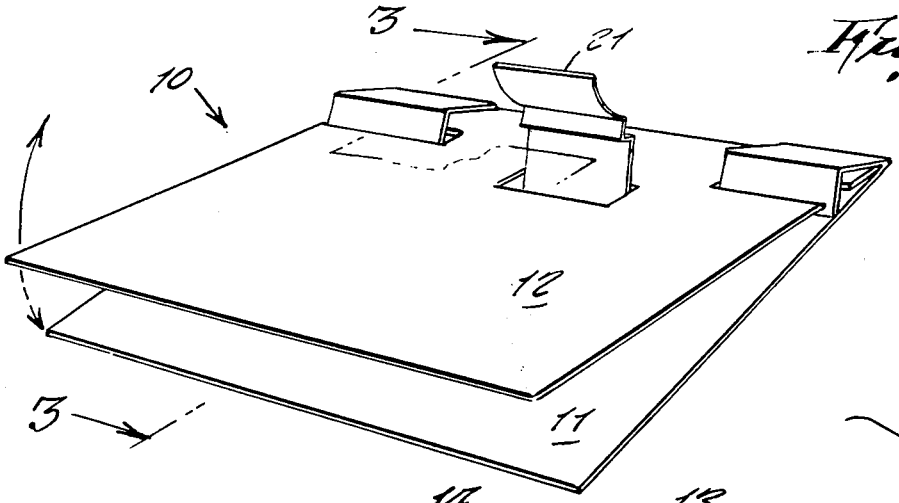
Fig. 1
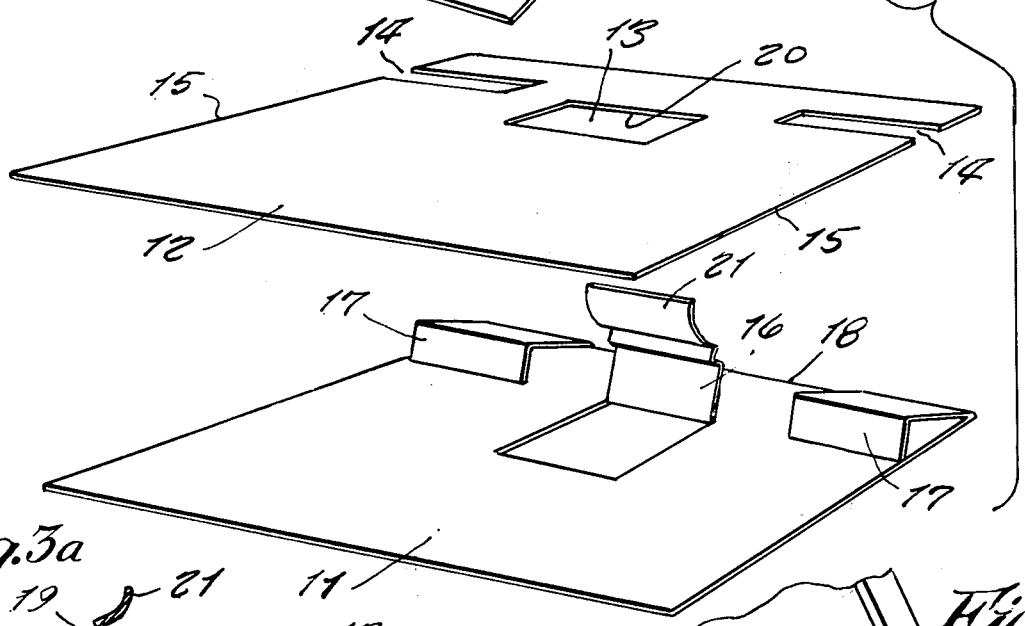
Fig. 2
Fig. 3a
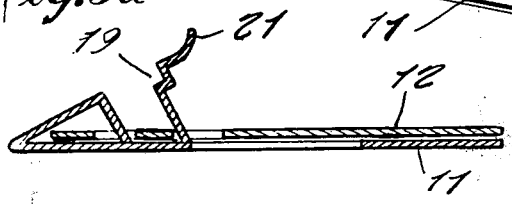
Fig. 3b
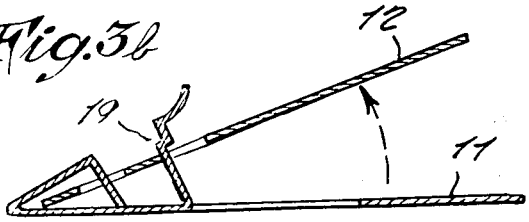
Fig. 3c
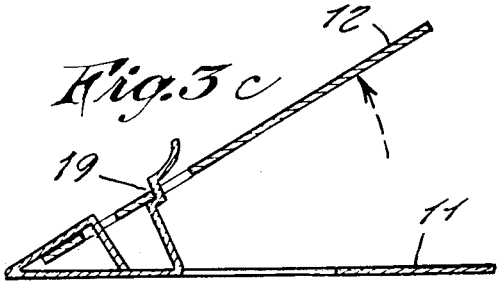
Fig. 4
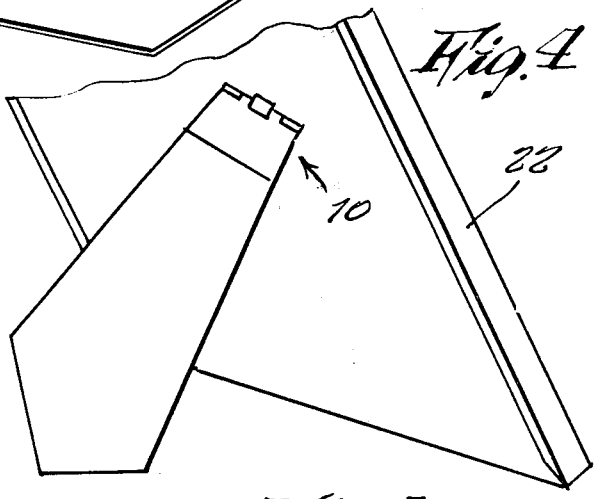
Fig. 5
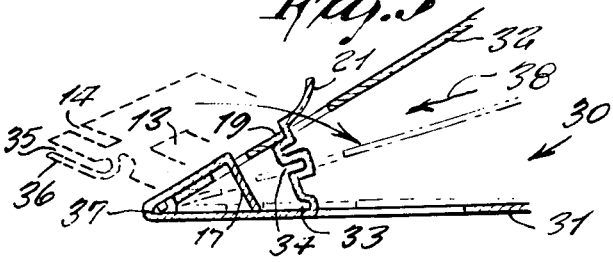

SNAP-LOCKING HINGE

This invention relates generally to hinge constructions.

A principal object of the present invention is to provide a snap-locking hinge, which automatically locks when moved into an open position, and which, optionally, allows for unlocking and reclosure of the hinge, as wished.

Another object of the present invention is to provide a snap-locking hinge, which, in various modified designs of the invention, additionally automatically locks in either partly opened or closed positions.

Other objects are to provide a snap-locking hinge, which is simple in design, inexpensive to manufacture, rugged in construction, easy to use and efficient in operation.

These, and other objects, will be readily evident upon a study of the following specification, and accompanying drawings, wherein:

FIG. 1 is a perspective view, showing one design of the present invention, shown assembled;

FIG. 2 is a perspective view of the hinge plates, shown separated from each other;

FIG. *3a* — *3a* is a cross sectional view taken on line 3—3 of FIG. 1, and showing the top and bottom hinge plates pivoted into a closed position.

FIG. *3b* — *3b* is a similar view thereof showing the hinge plates pivoted partially away from each other.

FIG. *3c* — *3c* is a similar view thereof showing the hinge plates pivoted fully apart and locked in opened position.

Figure 6:
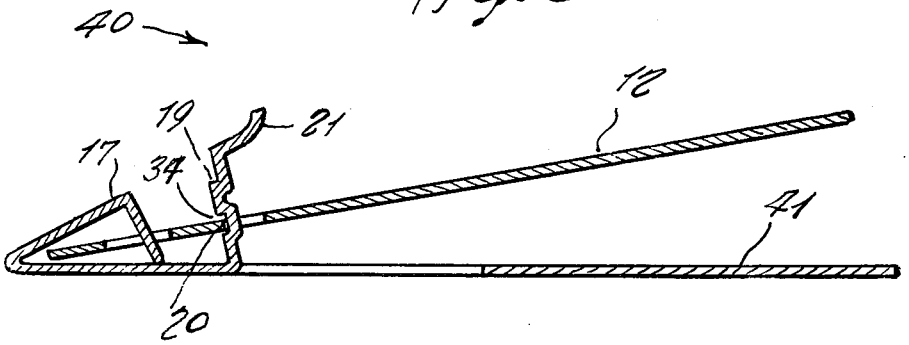
Figure 7:
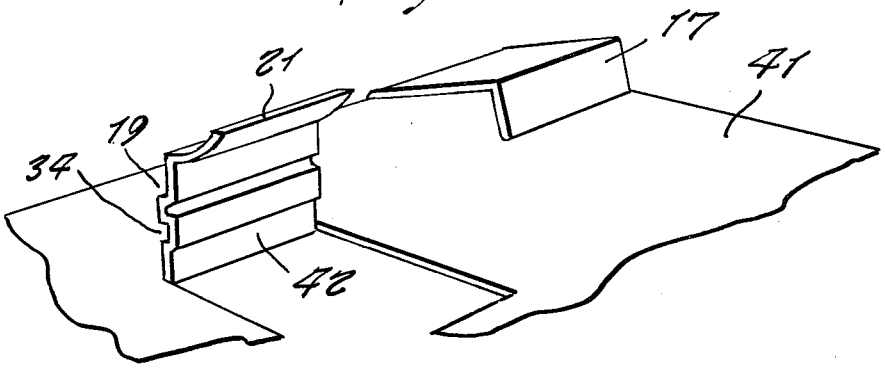
Figure 8:
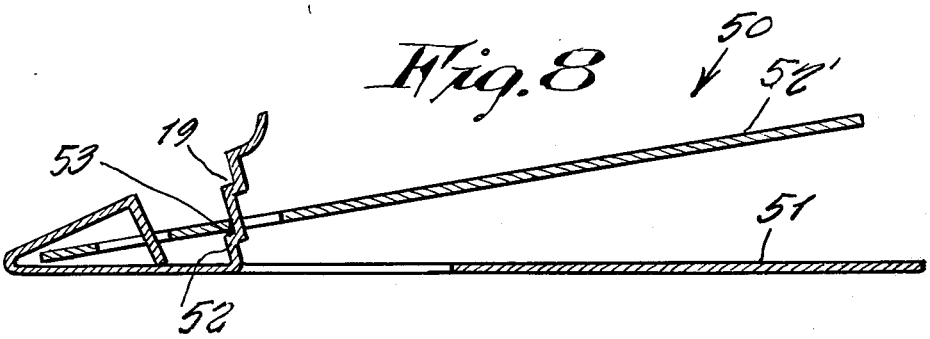

FIG. 4 illustrates the present invention, applied to an easel supported picture frame;

FIG. 5 is a side cross-sectional view, showing a modified design of the invention, in which the hinge can be selectively locked at either a fully opened, partly opened or closed positions;

FIG. 6 is a side cross-sectional view of a further modified design of the invention;

FIG. 7 is a fragmentary perspective view of a bottom plate, illustrated in FIG. 6;

FIG. 8 is a view similar to FIG. 6, and which illustrates still another modified design thereof.

Referring now to the drawings in greater detail, and more particularly to FIGS. 1 through 3 thereof at this time, the reference numeral 10 represents a snap-locking hinge, according to the present invention, wherein there is a bottom hinge plate 11, and a top hinge plate 12. The top plate has a rectangular central opening 13, and a slot 14, on each opposite side edge 15 thereof. The bottom hinge plate includes a snap-locking member 16, struck out from a center thereof, for fitting into the central opening 13 of the top hinge plate. Additionally, the bottom plate has a hinge guide 17, bent up at each end of an end edge 18, the hinge guides fitting into the slots 14 of the top hinge plate.

The snap-locking member 16 includes a shoulder 19, upon which an edge 20, of the central opening 13, gets locked, when the top hinge plate 12 is upwardly pivoted to the position, as shown in diagram *c* in FIG. 3. The snap-locking member is bent over a distance, so as to bear against the edge 20 as the top plate is upwardly pivoted, and when the top plate gets above the shoulder 19, the snap-locking member then snaps, so that the shoulder gets under the top plate, and thus retains the top plate from returning pivotally back into the closed position. A release tab 21, formed upon the terminal end of the snap-locking member, is provided for a person to push thereagainst, in order that the shoulder is pulled away from under the top plate, and thus clears the edge 20, in order that the top plate can then be willfully downwardly pivoted into a closed position.

The hinged plates may be made of any desired material, depending upon the intended uses of the hinge. Thus, they may be made of a cheap plastic material, wherein the snap-locking member is spring flexible, in order that the shoulder snaps under the edge 20. Alternately, the hinge can be made of sheet metal members, as desired. In a modified design, the snap-locking member may be designed to terminate at the shoulder, without the release tab being included.

As shown in FIG. 4, the above described hinge 10 can be incorporated in the construction of an easel supported picture frame 22, and which serves to prevent the support from accidentally collapsing.

In a modified design, shown in FIG. 5, a snap-locking hinge 30, shown in FIG. 5, includes bottom hinge plate 31 and top hinge plate 32, the bottom hinge plate including the above described central opening 13, and the side edge slots 14, while the bottom plate includes the hinge guides 17, and a modified design of snap-locking member 33.

The snap-locking member 33 is shaped so as to include a notch 33, for holding the top plate in a closed position, an intermediate notch 34, for holding the top plate in a partly open position, and the above described shoulder 19, for holding the top plate in a fully opened position. The above described release tab 21 is also included. Thus, in this form of the invention, the top plate can be snap-locked, and held in any of three different positions. In this design the top plate, additionally, includes a struck-out slot 35 on each side edge, in order to form a spring finger 36, for resting within the corner 37 formed by each hinge guide 17. In willfully moving the top plate between any of the positions, the top plate is first pushed in a direction as indicated by arrow 38, in order that the edge 20 is thus released from either of the notches 33 or 34, or the shoulder 19. Thus, the top plate can be freely pivoted, without flexing the snap-locking member by pushing the release tab 21.

Reference is now made to FIGS. 6 and 7 of the drawings, wherein another modified design of snap-locking hinge 40 includes all of the above described elements, that are present in FIG. 5, except that it does not include the notch 33, used to retain the top plate in a closed position, and it does not include the spring finger 36 or notch 35, so that the top plate is in no way altered from the top plate 12, shown in FIG. 2. FIG. 7 illustrates a fragment of the bottom hinge plate 41, which is thus an alteration of the above described bottom hinge plate 31, due to the change in the additionally altered snap-locking member 42.

Referring now to FIG. 8, still another modified design of snap-locking hinge 50 includes top hinge plate 52', and a bottom hinge plate 51, wherein an additionally modified design of snap-locking member 52 includes shoulder 19 and also a shoulder 53, the latter of which retains the top plate in a partly open position.

Thus, different forms of the invention are provided.

While various changes may be made in the detail construction, it is understood that such changes will be within the spirit and scope of the present invention, as is defined by the appended claims.

What I now claim is:

1. A snap-locking hinge, comprising in combination, a top hinge plate and a bottom hinge plate, said top hinge plate having a central opening and a slot on each opposite side edge, and said bottom hinge plate having hinge guides engaging such slots and a snap member engaging said central opening; said snap-locking member including a shoulder engaging an edge of said central opening when said top hinge plate is in a fully opened position; and snap-locking member additionally including a notch engaging said central opening edge when said top plate is in a partly closed position; said snap-locking member including a second notch engaging said central opening edge when said top plate is in a closed position; and spring means on said top plate allowing sliding of said plate laterally respective to said bottom plate, for disengaging said opening edge from said snap-lock member, said spring means comprising a struck-out notch on each said opposite side edge of said top plate, thus forming a narrow, resilient spring finger, that is located beyond a top plate end edge, about which said top plate pivots within said hinge guide, so that lateral sliding of said top plate thus forces said spring finger to move toward said end edge, in order to provide said disengagement.

2. The combination as set forth in claim 1, wherein said snap-locking member includes a second shoulder engaging said central opening edge when said top plate is in a partly hinged open position.

* * * * *